US005938184A

United States Patent [19]

DeSouza

[11] Patent Number: 5,938,184

[45] Date of Patent: Aug. 17, 1999

[54] PLASTIC FENCE CONSTRUCTION

[75] Inventor: Joseph DeSouza, North Royalton, Ohio

[73] Assignee: Action Sales & Marketing, Inc., Middleburg Heights, Ohio

[21] Appl. No.: 09/092,382

[22] Filed: Jun. 5, 1998

Related U.S. Application Data

[60] Provisional application No. 60/048,861, Jun. 6, 1997.

[51] Int. Cl.[6] ..... E04H 17/14

[52] U.S. Cl. ..... 256/19; 256/24; 256/65

[58] Field of Search ..... 256/19, 21, 22, 256/24, 59, 65, 66

[56] References Cited

U.S. PATENT DOCUMENTS

| | | | |
|---|---|---|---|
| 3,083,951 | 4/1963 | Huret | 256/22 X |
| 3,113,760 | 12/1963 | Huret et al. | 256/21 X |
| 3,652,060 | 3/1972 | Glover | 256/19 |
| 3,858,850 | 1/1975 | Maxcy et al. | 256/22 |
| 4,214,734 | 7/1980 | Stafford | 256/24 |
| 4,346,872 | 8/1982 | Tornya | 256/65 |
| 4,809,955 | 3/1989 | Veilleux | 256/19 X |
| 5,480,126 | 1/1996 | Teasdale | 256/19 |

*Primary Examiner*—Lynne Reichard
*Assistant Examiner*—David E. Bochna
*Attorney, Agent, or Firm*—Pearne, Gordon, McCoy & Granger LLP

[57] ABSTRACT

A fence unit extending between vertical posts is formed using extruded plastic top, middle and bottom rails resting on hangers attached to the posts. Each of the rails has parallel side walls as well as top and bottom walls and a pair of internal wall portions extending between the side wall portions. A reinforced member in the form of a channel extends through each of the rails between the internal wall portions. The bottom rail has the top a wall cut away to form a groove while the top rail has the bottom wall cut away to form a groove and the middle rail has both the top and bottom rails cut away in a similar manner. The assembly then includes boards or panels adapted to fit between the top and middle rails and the middle bottom rails and extending into the grooves to abut the adjacent internal wall portions and screw fasteners extend into the rail portions to hold the assembly together as a unit.

6 Claims, 2 Drawing Sheets

Fig.1
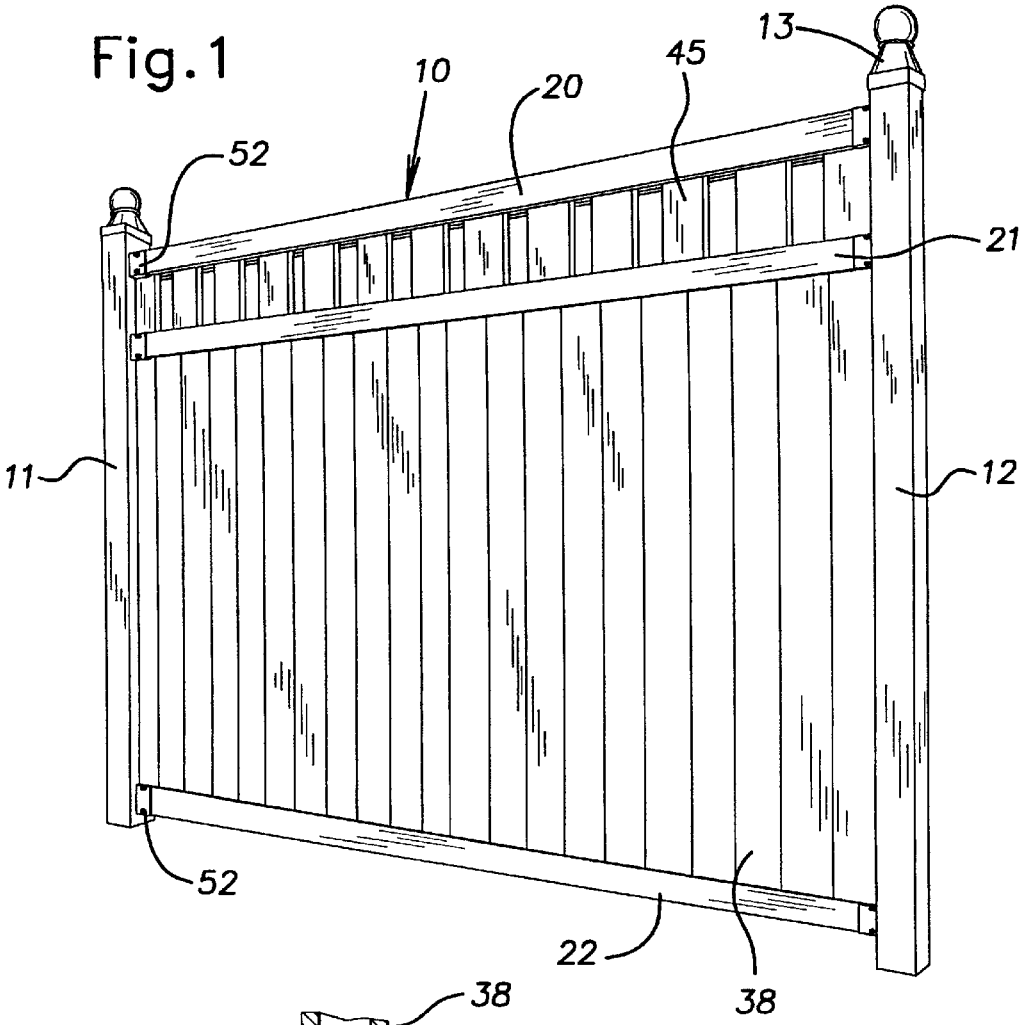
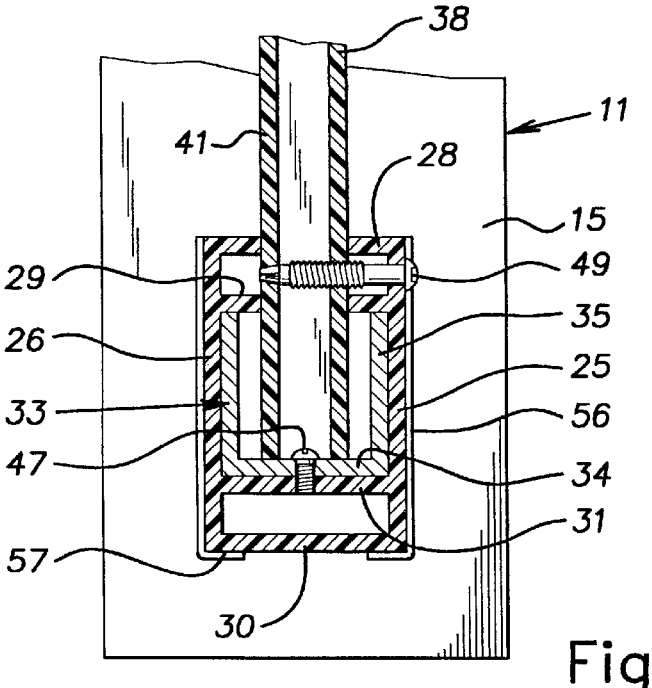
Fig.3

PLASTIC FENCE CONSTRUCTION

CROSS-REFERENCE TO RELATED APPLICATION

This application claims the benefit of U.S. Provisional Application No. 60/048,861, filed Jun. 6, 1997.

BACKGROUND OF THE INVENTION

The present invention relates to a plastic fence construction which allows rapid and simple assembly while providing a strong and impact resistant construction utilizing members extruded from polyvinyl acetate or other similar material.

Fences have long been used for both utilitarian and decorative purposes, using wood as the primary material because of low cost, ease of handling, and because it gives a desirable sense of size and strength as compared to metal. The most common way of constructing such a fence is to use a number of wooden posts placed in the ground at regular spaced intervals. Lower and upper rails are then placed horizontally between the posts and fastened to them, and then boards or spindles are positioned vertically, either between the rails or, if greater height is desired, along the sides or through openings in the rails to extend above the top rail. Depending upon the application and cost of the fence, many variations in the finished design are possible, and many of these have achieved such a high degree of acceptance that they have become well known in the trade.

However, wood has many disadvantages, such as being relatively heavy for a given strength, as well as splitting and breaking under impact. Furthermore, wood will tend to rot and decay under most conditions and must be protected either by a preservative finish using an expensive chemical treatment or else painted with appropriate decorative finishes which must be reapplied periodically. Thus the complete cost of a wood fenced is not only the original cost of erecting it, but also the continuing cost of maintenance and repair.

In order to overcome the problems with wood as a fencing material, a number of substitutes have been proposed, particularly plastics, and of these polyvinyl chloride or PVC has been one of the most popular. PVC has the advantages of easy fabrication by extrusion, molding and other processes, as well as reasonable cost and durability, since it can easily be coated with the necessary protective and finishing materials.

Since PVC has approximately three times the density of a typical wood used for fencing, and because of its much higher strength, it is generally formed in hollow extrusions that are shaped to resemble wood boards and posts that essentially are hollow, with walls thick enough to provide the necessary strength and an open center core. In some cases, a core may be filled with wood, usually in the case of posts, for greater strength, and to allow external hardware, such as hinges and latches, to be attached using ordinary screws and bolts. In the case of elongated boards, however, the high width-to-thickness ratio requires the use of internal walls, generally running perpendicular to the long sides and parallel with the end walls, to provide the necessary rigidity. While this arrangement tends to be sufficient for the boards that may be used in either a horizontal or vertical position, fence structures with vertical boards are often used for privacy purposes where the boards are abutted edgewise in a generally vertical position and are supported on top and bottom rail members which extend horizontally between the posts. This arrangement requires rail members to be formed of substantially heavier material to take the weights of the intervening boards and other loads and, from a point of cost and structural strength, it has generally been found desirable to use rail members having the internal cross walls and also a suitable steel channel member in the central portion, not only to provide beam strength, but also, in some cases, to receive suitable screw fasteners for holding the unit together.

In the case of many popular fence styles where a privacy fence that is six feet high or more is desired, it has been found desirable to use three horizontal rails, which also provide a changing pattern for decorative purposes.

Another problem that has been encountered is the method of attaching horizontal boards or rails to the posts. While in some cases the horizontal rails or boards may be simply fastened to the side of the post with bolts that go all the way through the post, this has been considered to be an unattractive arrangement, and there has been a tendency to use hollow posts with openings in the sides shaped to receive the boards or rails which then must be longer in length than the space between adjacent post sides. This arrangement makes it difficult to use a central core to stiffen the post, and therefore, it does not give strong support for the horizontal fence members. Not only do the openings in the side walls of the post weaken the post, but the load must be taken edgewise on the bottom of the openings. Furthermore, unless additional fasteners are used, the horizontal rails or boards must be a relatively loose fit in the openings, which does not result in a tight structure.

SUMMARY OF THE INVENTION

The present invention provides an improved rail structure, allowing easy fabrication, so that top metal and bottom rails can be made from the same basic PVC extrusion utilizing only milling-type cuts to provide openings to receive vertical boards. Since the chips removed are recyclable, this does not really cause any waste of material, and allows different positions for the cuts and for a reinforcing channel to provide the different configurations required for the middle and for the top and bottom rails.

Another feature of the invention is the use of a new mounting bracket which requires no cut-outs in the walls of the posts, except for screw-type fasteners, and yet, with a simple folded sheet metal construction, provides anchoring and support for each of the rails, using identical bracket arrangement. With this construction, any or all of the posts can have wooden cores for reinforcing, and the entire modular arrangement of posts and fence sections between the posts requires a minimum number of different parts, which results in definite cost savings in tooling and inventory, as well as simplified construction in the field.

BRIEF DESCRIPTION OF THE DRAWINGS

FIG. 1 shows a perspective view of a typical fence arrangement modular unit, including a pair of posts and a wall section extending between them;

FIG. 3 is an enlarged cross-sectional view through the lower rail taken on line 3—3 of FIG. 2.

DETAILED DESCRIPTION OF THE INVENTION

Figure 2:
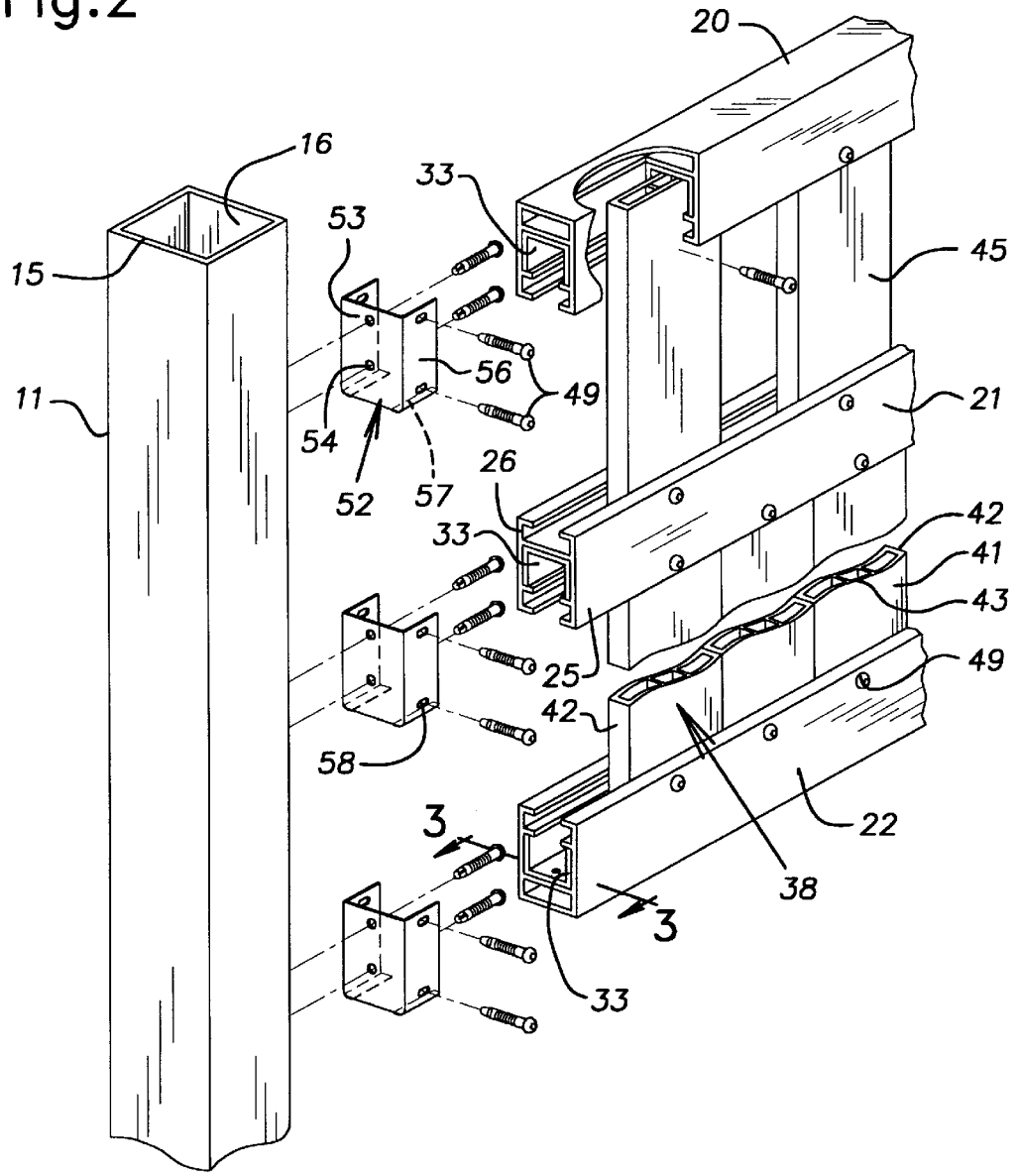
FIG. 2 is an exploded view showing the assembly details of the fence rails and boards together with the mounting bracket.

Referring to the drawings in greater detail, FIG. 1 shows a typical fence section 10, including end posts 11 and 12.

The posts 11 and 12 are normally sunk into the ground and concrete and are precisely spaced, normally on eight foot centers, and are firmly in position before the wall section is assembled. Each of the posts may be provided with a suitable top cap 13 and comprises, as better shown in FIG. 2, a square wall 15 extending around an open core 16. These posts are preferably extruded from a suitable polyvinyl chloride, or PVC compound, as is well-known in the art and, particularly for supporting posts and corner posts, the open core 16 may be filled with a wood or other type of stiffening core.

The fence section itself, in the model that is shown for purposes of illustration, includes a top rail 20, a middle rail 21, and a bottom rail 22. The top rail 20 and bottom rail 22 are identical in construction, but inverted in position, to receive the tops and bottoms of the fence boards. The middle rail 21 has a second open slot, but all rails are originally formed from the same basic PVC extrusion. The extrusion is rectangular in shape, with side walls 25 and 26 that may have a dimension of 2¾ inches and are spaced apart to define a thickness of 1¾ inches. This spacing is accomplished by providing four laterally-extending walls, with top and bottom outer walls 28 and 30 extending flush from the edges of the side walls 25 and 26, and with inner walls 29 and 31 extending between the side walls a spaced distance inward from the outer walls 28 and 30. In the case of the top rail 20, a bottom outer and inner walls 30 and 31 are cut-away to define a slot approximately ¾ inch wide. In the case of the middle rail, the other outer wall 28 is also cut-away in the same way, leaving only the single top inner wall 29 connecting the side walls 25 and 26.

Reinforcing is provided by a steel channel 33 extending in the space between the inner walls 29 and 31, with an end wall 34 extending transversely and abutting the top inner wall 29, and having side walls 35 extending along the inner faces of the side walls 25 and 26 to terminate adjacent the other inner wall 31. Preferably, the channel 33 is a fairly snug fit within this space and extends unbrokenly from one end to the other to provide the required stiffening for the PVC material. In order that the channel may remain in place during shipping and assembly, suitable screws 47 are provided at several places along the length, as shown in FIG. 3, to fasten the channel end wall 34 to the adjacent inner wall of the PVC rail. The channel 33 is preferably formed of galvanized steel, although it is possible that aluminum or other materials could be used in its place.

Each space between the middle rail 21 and bottom rail 22 is filled by a plurality of vertically-extending lower boards 38, and in the style shown, these abut edge-to-edge to fill the entire space to provide a privacy wall. However, the boards can be spaced apart or solid panels, or latticework can be used to fill the space between the rails. The boards 38 include a pair of sides 41 spaced apart by flush end walls 42 and internal walls 43 to provide a structure well-known in the art for PVC fence boards. The boards 38 extend downward through the two open cross walls in the bottom rail 22 to abut against the channel end wall 34, while their upper ends extend through the two walls of the middle rail 21 to also abut against the middle rail channel end wall. Likewise, upper boards 45 extend from the top inner wall 29 of the middle rail 21 upward through the open lower ends of the bottom walls 30 and 31 of the top rail 20 to abut against the channel end wall 34 in the top rail. As shown for decorative purposes, the upper boards 45 are spaced alternatingly with equal spaces, but this is purely for decorative purposes. Since the ends of both the lower boards 38 and the upper boards 45 abut against rail walls, the result is a relatively rigid structure. To hold everything together, screws 49 extend through the PVC portions of one of the side walls 26 of the three rails 20, 21, and 22. As best shown in FIG. 3, the screws 49 are self-tapping and extend through the one rail side wall 26 and through both side walls of the adjacent board to hold the assembly together.

The fence assembly is attached to each of the posts 11 and 12 by means of a metal bracket 52. All of the brackets 52 are identical, and there is one bracket for each rail end. The bracket 52 has an end face 53 which abuts the post 11 and is provided with screw holes 54, and the screws 49 extend through the screw holes 54 into the post wall 15. The end face 53 is generally rectangular in shape and has a pair of parallel-extending side flanges 56 extending along each of the rail walls 25 and 26 to firmly position the rail in place. At the bottom of each of the side flanges 56 are short, inwardly-extending flanges 57 sufficient to support the rail without interfering with the adjacent board, which extends into the space between the bottom flanges 57. The side flanges 56 are provided with suitable screw holes 58 receiving screws 49 to secure each of the rails separately to the adjacent post.

In the assembly of the fence section, advantage is taken in the fact that the vertical load is taken on the inwardly extending flanges 57. At the beginning of the assembly the two posts 11 and 12 are permanently set in place in the ground making sure that the tops are of uniform height. After the posts are in place all six brackets are attached to the parts at the proper height to ensure that the fence is level. The lower rail 22 is then placed in the bottom pair of hangers after which the lower boards or panels 38 are set in place within the open upper end of the bottom rail 22 and the middle rail 21 is then placed over the top ends of the boards 38 to rest in place on its set of brackets. The upper boards or panels 45 are now also put in place followed by the top rail 20. Preferably no fasteners are used until the assembly is complete since the grooves in the rails 20, 21 and 22 should hold the two board sets 38 and 45 in place temporarily. After this is done, all of the screws 49 are driven in place as desired to prevent lateral movement of the boards in the rails and also to secure the rails to the adjacent brackets.

Although a preferred embodiment of the invention has been shown and described, it is recognized that many variations are possible. For example, it is not necessary to have the middle rail if only top and bottom rails are required and either the boards 38 or the boards 45 may be used in other patterns or complete lattice panels or other panels may be substituted for the boards.

I claim:

1. A fence section comprising top, middle and bottom rails extending parallel and horizontally, each of said rails being a rectangular plastic extrusion having parallel side walls with parallel top and bottom walls, each of said rails having a pair of internal walls extending between said side walls parallel to and adjacent said top and bottom walls, a reinforcing member extending longitudinally within each of said rails between said internal walls, said bottom rail having the top and adjacent internal walls cut away to form a groove, said top rail having the bottom and adjacent internal walls cut away to form a groove, said middle rail having both the top and bottom walls and one internal wall cut away to form top and bottom grooves, and at least one panel member extending vertically between said bottom and middle rails and another panel member extending vertically between said middle and top rails, each panel member extending into each adjacent groove to abut one of said adjacent internal walls on said middle rail and abut said reinforcing members on said top and bottom rails.

2. A fence section as set forth in claims 1, wherein said reinforcing member is a metal channel.

3. A fence section as set forth in claim 2, wherein said channel has an open side facing a groove.

4. A fence structure comprising a pair of vertical posts, top, middle and bottom rails extending horizontally between said posts, a hanger bracket at each end of said rails securing said rails to the adjacent post, each of said rails being a rectangular plastic extrusion having parallel side walls with parallel top and bottom walls, each of said rails having a pair of internal walls extending between said side walls parallel to and adjacent said top and bottom walls, a reinforcing member extending between said vertical posts within each of said rails between said internal walls, said bottom rail having the top and adjacent internal walls cut away to form a groove, said top rail having the bottom and adjacent internal walls cut away to form a groove, said middle rail having both the top and bottom walls and one internal wall cut away to form top and bottom grooves, and at least one panel member extending vertically between said bottom and middle rails and another panel member extending vertically between said middle and top rails, each panel extending into each adjacent groove to abut one of said adjacent internal walls on said middle rail and abut said reinforcing members on said top and bottom rails.

5. A fence structure as set forth in claim 4 wherein each of said hanger brackets has an end face secured to the post and side flanges extending along the side walls of the adjacent rail, each of said side flanges having a bottom flange extending inward beneath the rail bottom wall.

6. A fence structure as set forth in claim 5 wherein said bottom flanges have edges spaced apart to define a groove for receiving the adjacent panel.

* * * * *